United States Patent [19]

Gibb et al.

[11] Patent Number: 4,470,291

[45] Date of Patent: Sep. 11, 1984

[54] PIPE-LOCKING FORMATION METHOD AND APPARATUS

[75] Inventors: John Gibb, Bolton; Jozsef Horvath, Islington, both of Canada

[73] Assignee: Victaulic Company of Canada Limited, Rexdale, Canada

[21] Appl. No.: 368,010

[22] Filed: Apr. 13, 1982

[51] Int. Cl.[3] ..... B21D 17/02

[52] U.S. Cl. ..... 72/414; 51/236; 269/60; 269/289 MR; 269/902

[58] Field of Search ..... 72/370, 414, 415, 420, 72/428; 51/236; 269/60, 289 MR, 902

[56] References Cited

U.S. PATENT DOCUMENTS 2,733,330 1/1956 Blewett ..... 269/289 MR 4,052,880 10/1977 Cullinan et al. ..... 72/370

*Primary Examiner*—E. Michael Combs

*Assistant Examiner*—Linda McLaughlin

*Attorney, Agent, or Firm*—Abelman Frayne Rezac & Schwab

[57] ABSTRACT

A method and an apparatus for forming arcuate radially-extending locking projections on the ends of pipes is disclosed, in which the pipe end is marked about its external circumference into spaced forming zones, and the projections are then formed employing one of the zone markings as an index of the location of a second zone marking spaced therefrom, the apparatus including an elevatable pipe support and a forming head provided with a male punch assembly and a female die member, the male punch assembly being operable by a power source and being located within the bore of the pipe.

7 Claims, 14 Drawing Figures

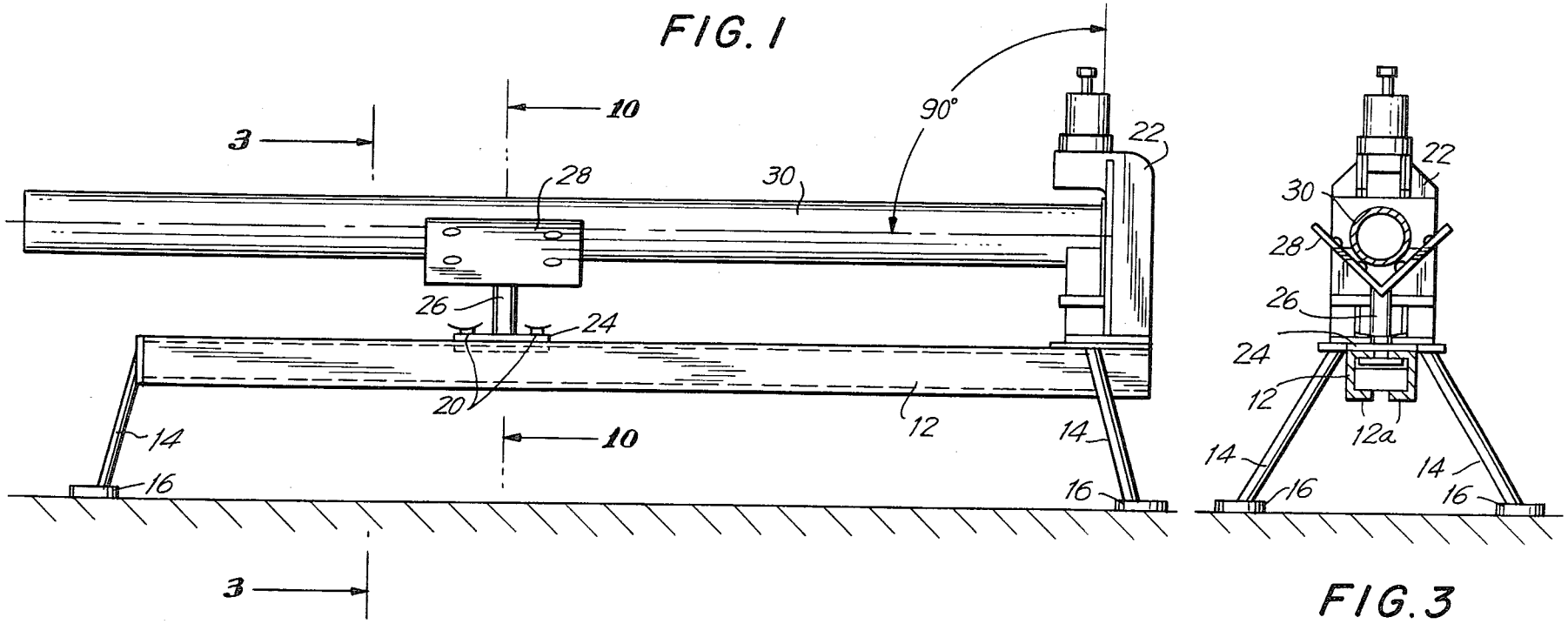
FIG. 1
FIG. 3
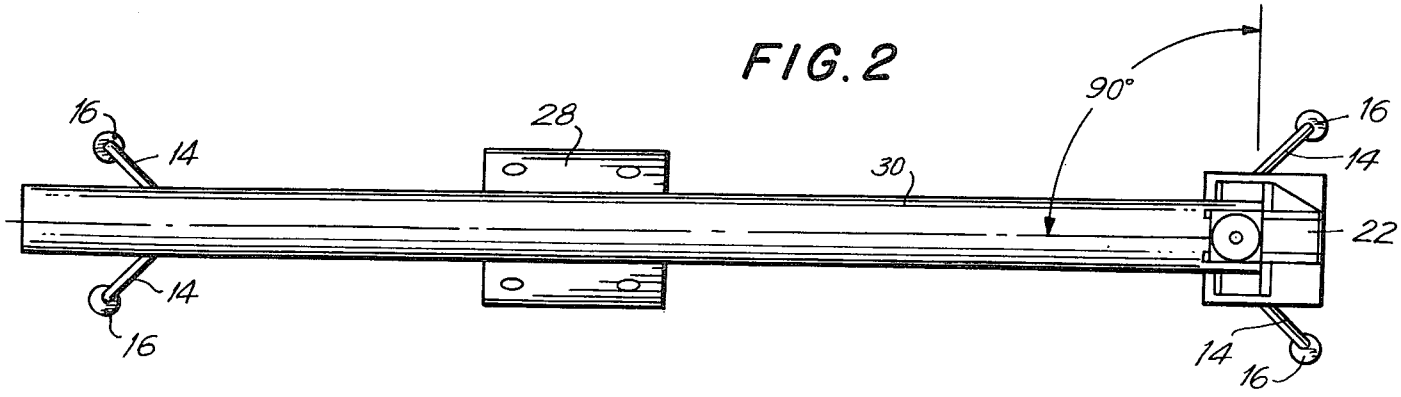
FIG. 2

FIG. 4
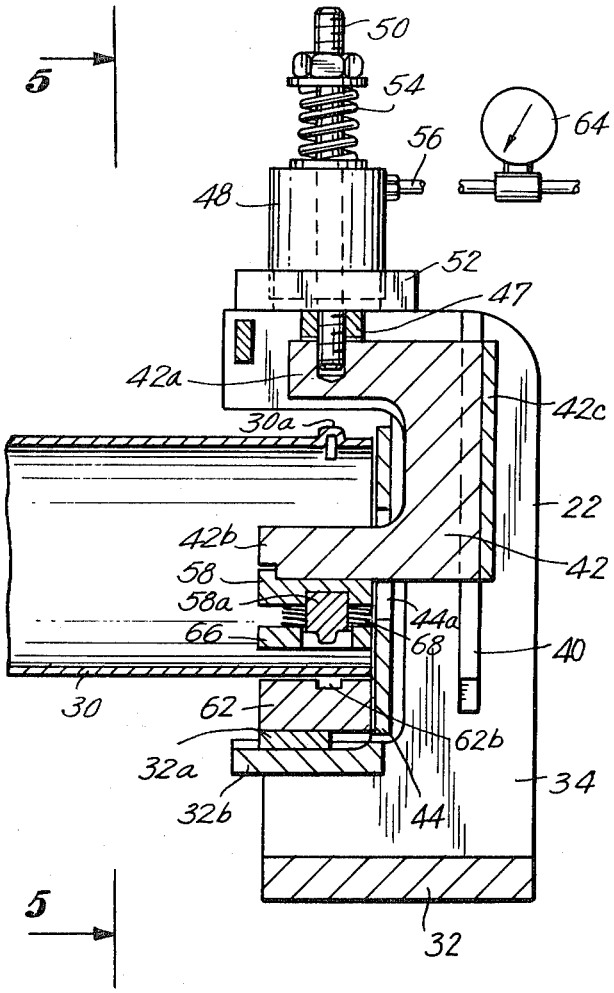
FIG. 5
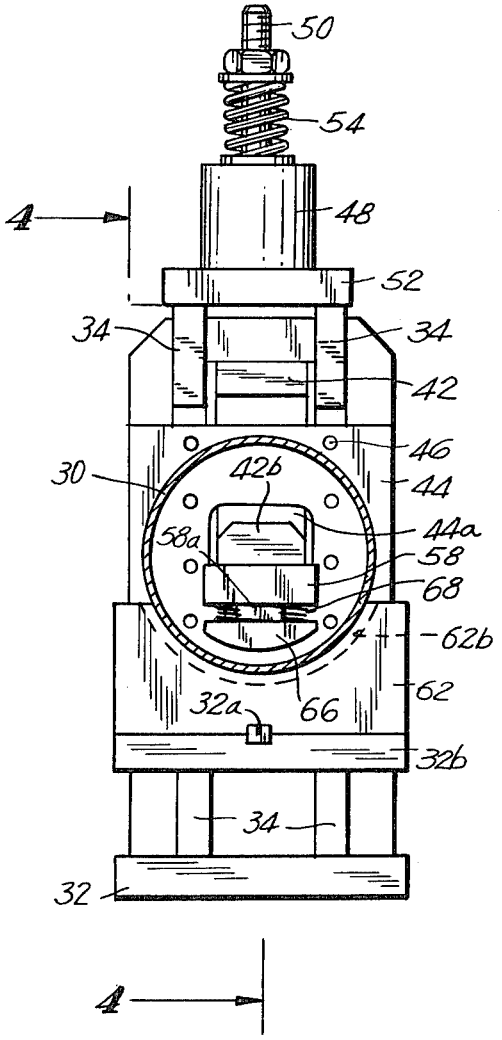
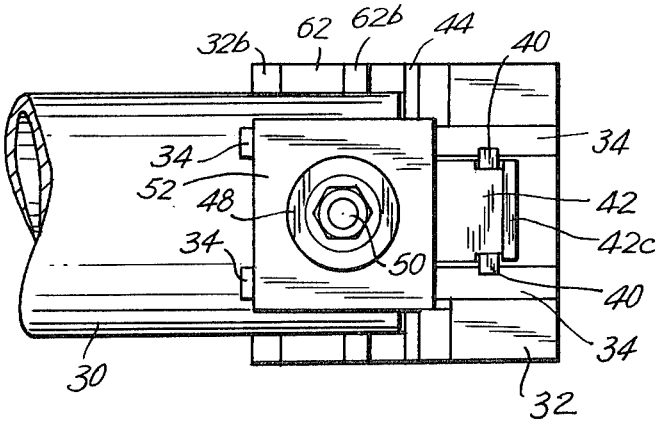
FIG. 6

PIPE-LOCKING FORMATION METHOD AND APPARATUS

FIELD OF THE INVENTION

This invention relates to a method of applying arcuate radially-extending locking projections on the ends of pipes formed from a formable metal, such as carbon steel or stainless steel, and to apparatus specifically employed in the performance of the method.

While not limited thereto, the present application finds particular application in the formation of such locking projections on the ends of otherwise plain-ended pipe which is to be assembled into a pipeline assembly by the use of so-called "quick-connect" couplings.

Such couplings usually comprise arcuate coupling member halves having radially extending bolt pads at their ends. The respective coupling member halves are positioned around the adjacent ends of a pair of pipes in bridging relationship therewith, and are clamped to each other by bolts or the like. The clamping member halves include an internal channel for the reception of an annular gasket member which has been pre-positioned over the pipe ends in bridging relationship therewith, or, for the reception of a gasket member segment which is located and secured within the channel of each of the coupling member halves, and which is brought into bridging and sealing engagement with the pipe ends upon assembly of the coupling onto the pipe ends. The clamping member halves include a pair of internal grooves or channels for interlocking engagement with the projections on the pipe ends, such interlocking engagement preventing separation of the pipes under the action of pressure or vibration, and effectively limiting the amount of axial and angular displacement of the pipes relative to each other and the coupling.

The invention finds particular application in pipeline assemblies formed from thin-walled stainless steel pipe, such as is commonly employed in the food processing, chemical, wood pulp and paper manufacturing industries, in which the fluids to be conveyed are under pressure, and axial separation of the pipe ends must be inhibited under all normally expected processing conditions. Attempts at employing plain-ended pipes and an appropriately configured coupling member have not been entirely successful, in that slippage of the pipe or the pipe ends relatively to the coupling member can occur under conditions of mechanical vibration, or pulsation or overpressure of the conveyed fluids, or, a combination of such conditions. While provision on the coupling clamping members of incissor type teeth provides some improvement in performance, it has been found that on relatively thin walled pipes such devices have limited performance in terms of restraining the pipes against separation due to pressure thrust, mechanical vibration and other forces that can occur in a piping system. In addition, the risk arises of damaging the pipe walls through buckling under the teeth or puncturing of the pipe walls. Consequently, and particularly where thin walled pipes are utilized, it is found desirable to provide a positive interlock between the respective pipe ends and the coupling member in order that separation of the pipe ends cannot occur up to the maximum pressures normally associated with such thin walled pipes.

A known form of positive interlock, as is disclosed, for example, in U.S. Pat. Ser. No. 2,041,132, Johnson, issued May 19, 1936, involves the formation of the pipe ends with radially outwardly extending arcuate projections which are received within grooves at the respective axial ends of the coupling member, the arcuate projections cooperating with the walls of the grooves to provide a positive interlock between the pipe ends and the coupling and to inhibit axial displacement or angular displacement of the pipe ends relatively to the coupling and to each other.

While such an arrangement is admirable in those conditions where the pipeline assembly can be preplanned and the respective pipes cut to determined length and formed at their ends with the required arcuately extending projections at the point of manufacture of the pipes, problems arise in those conditions where the pipeline assembly must be adapted at the point of assembly to hitherto unknown or uncomtemplated conditions and which preclude the use of completely formed and finished pipes.

BACKGROUND OF THE INVENTION

It is the object of this invention to provide a method and an apparatus for forming the required arcuate radially-extended locking projections on the pipe ends at the actual point of assembly of the pipes into a pipeline assembly, thus permitting the ready fabrication of pipeline assemblies from standard stock lengths of pipe, or from non-standard lengths of pipe cut from standard stock lengths of pipe.

By forming the arcuate locking projections on to the pipes at the point of assembly rather than at the point of manufacture, the intransit handling of the pipes is greatly facilitated, and, the problem of intransit damage of the arcuate locking projections is eliminated in its entirety.

While the formation of the arcuate projections on the pipes at the point of assembly of the pipes would appear, superficially, to be a relatively simple matter, the finished form and relative position of the arcuate projections is in fact a matter requiring substantial accuracy, for example, if the projections are too close to the pipe ends then the coupling will not be in the correct relative position so that the gasket may overhang the pipe ends and leakage will occur, alternately, if the projections are skewed to the longitudinal axis of the pipe, difficulty will be encountered in assembling the coupling with possible malfunction and leakage occuring. Also, for proper performance of the coupling it is desirable that the projections lie in the same plane, perpendicular to the longitudinal axis of the pipes. Further, many of the pipes include a longitudinal seam. In such instances, the arcuate projections must be set off from the seam line. Additionally, distortion of the pipe from its truly circular condition must be minimized, and axial or radial displacement or distortion of the pipe ends should be avoided, or incomplete seating of the gasket can occur and the compressive stressing of the gasket throughout its circumference will not be constant, such conditions militating against satisfactory sealing of the pipe ends at the coupling.

OBJECT OF THE INVENTION

It is an object of this invention to provide a method and an apparatus specifically for use in that method, whereby either standard lengths of pipe or cut lengths of pipe, including seamed pipe, can be accurately formed at the assembly site with the required arcuate projections in the absence of any significant radial or axial distortion of the pipe ends such as would impair the sealing and locating capabilities of the coupling.

According to one feature of the invention, there is provided a method of forming pipe ends with radially extending arcuate projections, which includes the steps of dividing the external circumference of the pipe into spaced forming zones positioned respectively on each side of the longitudinal weld or seam in instances where the pipe is of welded construction, marking said zones on the exterior surface of the pipe, locating the pipe against axial or lateral displacement, employing a first said zone marking as an index of the location of a second zone spaced from said first zone, applying clamping pressure to the material of said pipe within second zone to hold said material against axial pull-back of the pipe material from the ends, effecting the formation of one said radial extending arcuate projection from within said pipe at said zone while maintaining said clamping pressure, releasing both the clamping and forming pressure and sequentially repeating the operation at each other said zones.

According to another feature of the invention, there is provided an apparatus for carrying out the method of the invention, the apparatus including an axially straight bed frame on which a pipe support member is slideably mounted for movement to a determined position, the pipe support member being lockable to the bed frame when in a selected position longitudinally thereof. At one end of the bed frame there is rigidly secured thereto a forming head including a stop member for engagement by and accurate positioning of a pipe end, and a female die member fixedly supported in the forming head in a determined position spaced forwardly from said stop member and intermediate the stop member and the pipe support member. A male punch member is movably supported within the forming head for vertical movement towards and away from the female die member, such movement being generated by the action of a suitable motive force. The working portion of the male punch member extends from behind the stop member and forwardly thereof into alignment with the female die member, such that the male punch member is contained within the ends of a pipe supported on the female die.

Preferably, the male punch member is provided with a retractable clamping shoe which forms the dual function of clamping a pipe end against the surface of the female die upon advance of the male punch member, and, stripping of the pipe from the male punch member upon retraction of this member.

The pipe support member is mounted on its associated guide members for pivoting movement in a horizontal plane, and, is adjustable in height in order to bring a pipe which is generally supported by the pipe support member and the female die into an orientation in which its longitudinal axis is parallel to the bed of the apparatus and at 90° to the plane of the stop member and forming head. Additionally, the pipe support member preferably includes universally pivoted members which, in addition to facilitating rotation of the pipe to permit the successive radially extending arcuate members to be formed, also facilitates axial movement of the pipe in order that the pipe end may be readily introduced into the forming head and removed therefrom subsequent to the formation of the respective arcuate projections.

DESCRIPTION OF THE ACCOMPANYING DRAWINGS

The invention will now be described with reference to the accompanying drawings, in which:

FIG. 1 is a side elevation of the apparatus according to the present invention;

FIG. 2 is a plan view thereof;

FIG. 3 is a cross-section thereof taken on the line 3—3 of FIG. 1;

FIG. 4 is a vertical cross-section taken through a forming head of the apparatus, line 4—4 of FIG. 5;

FIG. 5 is a front elevation of the forming head of FIG. 4 taken on the line 5—5 of FIG. 4;

FIG. 6 is a plan view of the forming head;

Figure 11:
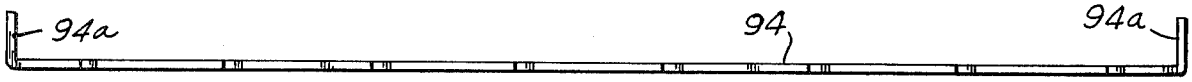
Figure 12:
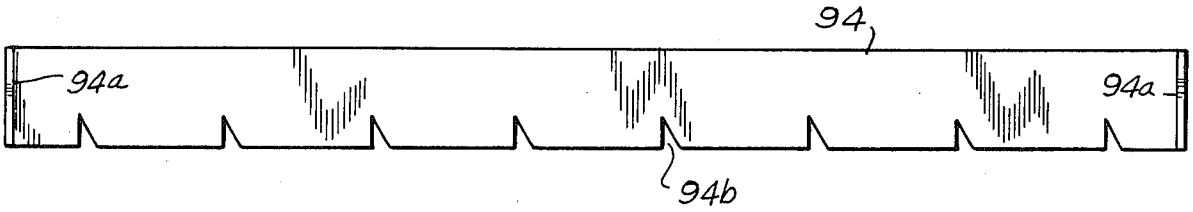
Figure 13:
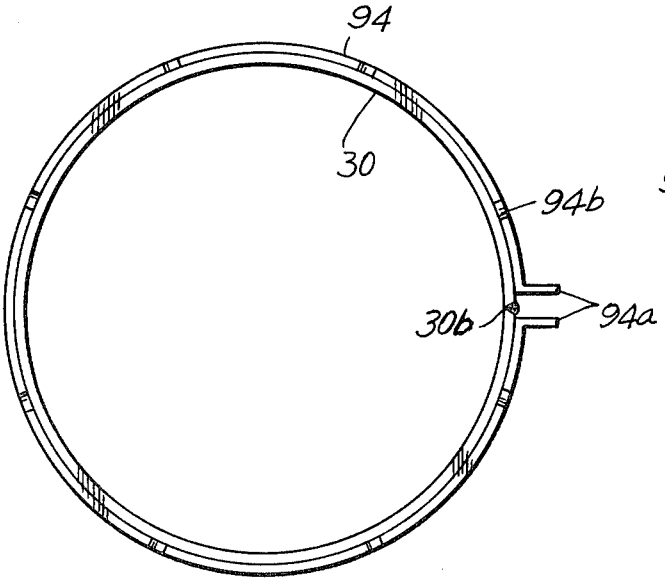
Figure 14:
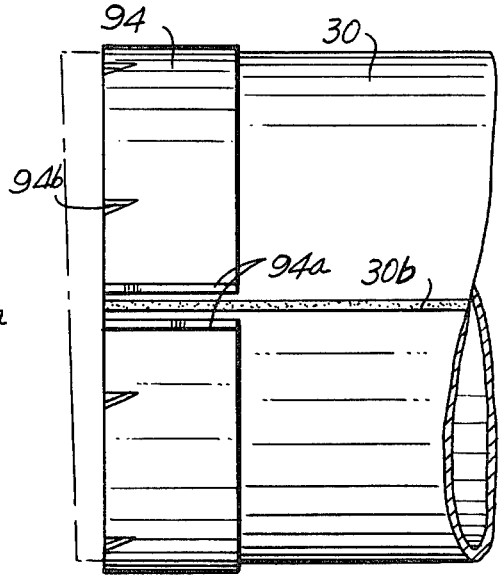

FIGS. 11 and 12 are respectively a front elevation and plan view of a gauge to be used in combination with the apparatus of the invention; and FIGS. 13 and 14 are respectively an end elevation and side elevation of the gauge of FIGS. 11 and 12 when applied to the end of a pipe.

Referring now to FIG. 1 to 3 of the drawings, there is shown an apparatus according to the present invention, the apparatus including an axially straight bed 12, which is supported by legs 14 having load distributing ground-engaging pads 16. As more clearly shown in FIG. 3, the bed 12 can conveniently be comprised of two spaced beams 12*a* of C-shaped transverse cross-section, the arms of the respective beams facing each other the respective beams 12*a* being interconnected at convenient points to further improve their dimensional stability.

Supported on the bed 12 and slideable longitudinally thereof is a plate 24 which is clampable to the bed 12, by clamping bolts 20. The clamping bolts 20 each have an enlarged head which engages the under side of the upper arms of the beams, and a shank which extends upwardly between the upper arms of the beams and through a hole in the plate 24, the bolts being located in position by appropriate nuts. When the bolts are released, they act as guide members permitting the plate 24 to be slid axially of the bed 12 to a required determined position longitudinally of the bed 12, the shanks of the bolts sliding within the space between the spaced upper arms of the beams 12*a*, and acting to guide the plate 24 in its movement longitudinally of the bed 12. The plate 24 normally will be positioned a distance from the operative face of a forming head, indicated generally at 22, which is one-half the length of the particular length of pipe to be worked upon in the forming head.

The plate 24 supports a vertical post 26, the post 26 in turn supporting a pipe support member 28. As is later described with reference to FIG. 10, the pipe support member 28 is mounted via the post 26 for pivoting movement in a horizontal plane, and to raise or lower the pipe in order to accommodate pipes of different diameters, and, to accurately position a pipe of a particular diameter in correct elevation relative to the female die 62.

In FIGS. 1 to 3, a pipe 30 is shown supported by the pipe support member 28 for the purposes of clarity of illustration. It will be understood that the pipe 30 is the workpiece to be worked upon, and, that the pipe 30 itself forms no part of the apparatus.

The pipe forming head 22 preferably is a unitary sub-assembly, which, for purposes of convenience in transporting the apparatus from one site to another, preferably is detachably attached to the bed 12 by any convenient means which will ensure a rigid and immovable connection between the bed 12 and the forming head 22. Similarly, for the purposes of ease of transportation, the pipe support member 28 and its associated components are removable from the bed 12.

Referring now to FIGS. 4, 5 and 6, which illustrate the forming head in detail, the forming head 22 includes a main frame comprised of a horizontal base member 32 which supports a pair of spaced vertical members 34. The vertical members may be formed unitarily with the horizonal member 32 as a unitary casting, or, they may be plates welded or otherwise secured thereto. At the upper ends, the spaced vertical members are interconnected by a horizontal platform 52, which, similarly may be formed integrally with the horizontal member 32 and spaced vertical members 34 as a unitary casting, or, be welded or otherwise secured thereto in any convenient manner.

Secured to the respective spaced vertical members 34, by means not shown, are a pair of vertically arranged and parallel aligned guides 40, which, in conjunction with face plate 42*c*, guide and support a carriage 42 for vertical reciprocating movement between the spaced vertical members 34. The face plate 42*c* is removably attached to the carriage 42.

The pipe forming head 22 has an abutment plate 44 secured to the face thereof facing the pipe support assembly 28, which is secured to the vertical members 34 by any convenient means such as by screws 46.

At its upper end, the carriage includes a forwardly extending boss 42*a* which underlies the platform 52, and, which is connected to the plunger 47 of a hydraulic piston and cylinder arrangement 48. The plunger 47 of the piston and cylinder arrangement extends downwardly through an aperture in the platform 52 to the boss 42*a*. The plunger 47 being interconnected by a bolt 50.

The piston and cylinder arrangement 48 is fastened to the platform 52, one means being by threaded connection.

The piston and cylinder arrangement, which preferably is hydraulically operated, can be of the one-way acting type, the piston of the arrangement being returned by spring 54, which may be contained within the piston and cylinder arrangement, or, be external thereto for the spring rate to be adjustable. The cylinder is provided with a suitable inlet connection 56 permitting the cylinder to be connected to a supply of hydraulic fluid under pressure, the supply and the valving arrangement thereof forming no part of the present invention.

At its lower end, the carriage 42 is provided with a forwardly extending boss 42*b* which extends through an aperture 44*a* in the plate 44, the clearance being required in that the boss 42*b* travels within the plate aperture 44*a*.

Attached to the under face of the lower boss 42*b* is a male punch assembly 58, the male punch assembly being secured to the lower boss 42*b* in any convenient manner, such as by bolts which are not shown. The male punch assembly has a punch 58*a* which cooperates with a female die member 62 which is rigidly attached to the horizontal member 32*b* by means of bolts which are not shown. Preferably, and as shown, the female die member is located on a key 32*a* in the horizontal base member 32*b* in order to locate it relative to the punch assembly 58.

The female die member 62 is arcuate and substantially semicircular in elevation, the radius of the inner periphery of the female die member being the same as that of the exterior periphery of the pipe 30. Internally of its inner periphery, the female die member 62 is grooved, as indicated at 62*b*, the axial width of the groove representing the width of the radially extending arcuate projections 30*a* to be formed in the pipe 30. The groove 62*b* is continuous throughout the entire inner periphery of the female die, thus permitting the groove to accommodate more than one formed arcuate projection and permitting rotation of the pipe about its longitudinal axis subsequent to the formation of one or more projections.

As is more clearly illustrated in FIG. 4, upon a forming stroke of carriage 42 and the male punch assembly 58, the punch 58*a* thereof will enter into the groove 62*b* of the female die member 62, and in so doing will displace radially outwardly a portion of the wall of the tube 30 to form a radially-extending arcuate projection 30*a* in the periphery of the wall of the pipe 30.

FIG. 4 illustrates the carriage when in a retracted position and prior to the supply of hydraulic fluid under pressure to the piston and cylinder arrangement 48. It is in this position of the male punch assembly 58 that the pipe is inserted into the forming head, the pipe being positioned such that at least one point of its end face contacts the abutment plate 44. This ensures that the formed radially extending arcuate projections 30*a* are positioned at an exact distance from the free end of the pipe 30.

Preferably, and in order to obtain an indication that the forming operation has been completed, a pressure gauge 64 is associated with the piston and cylinder arrangement 48, the gauge 64, during operation of the forming head exhibiting a rise in pressure at a constant rate as the carriage 42 is forced downwardly against the bias of the springs 68, followed by a sudden increase in pressure as the male punch engages the inner wall of the pipe 30, the gauge then indicating a further gradual rise in pressure as the forming progresses. Once the forming operation has been completed and further downward movement of the male punch assembly 58 is inhibited, the pressure gauge 64 will then show a sudden and sharp rise in pressure to the maximum line pressure, thus giving to the operator a clear indication that the forming operation has been successfully completed.

Figure 7:
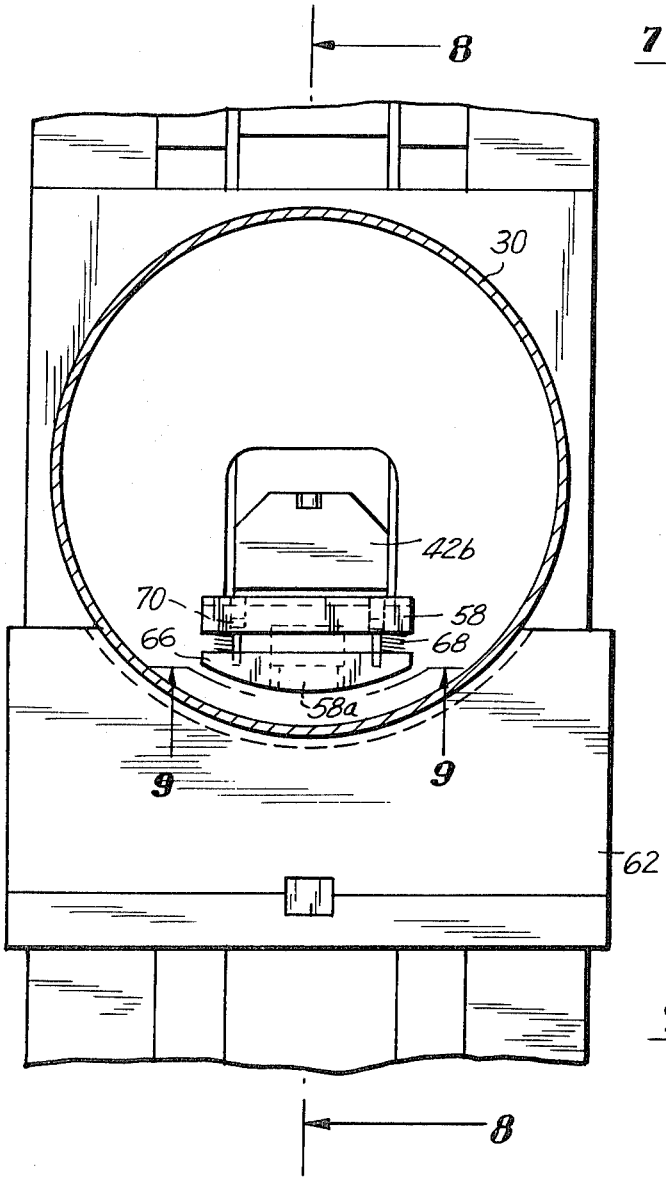
FIG. 7 is an enlarged partial view of FIG. 5 showing the die and punch assembly in greater detail, and is also a view taken through the line 7—7 of FIG. 8.
Figure 8:
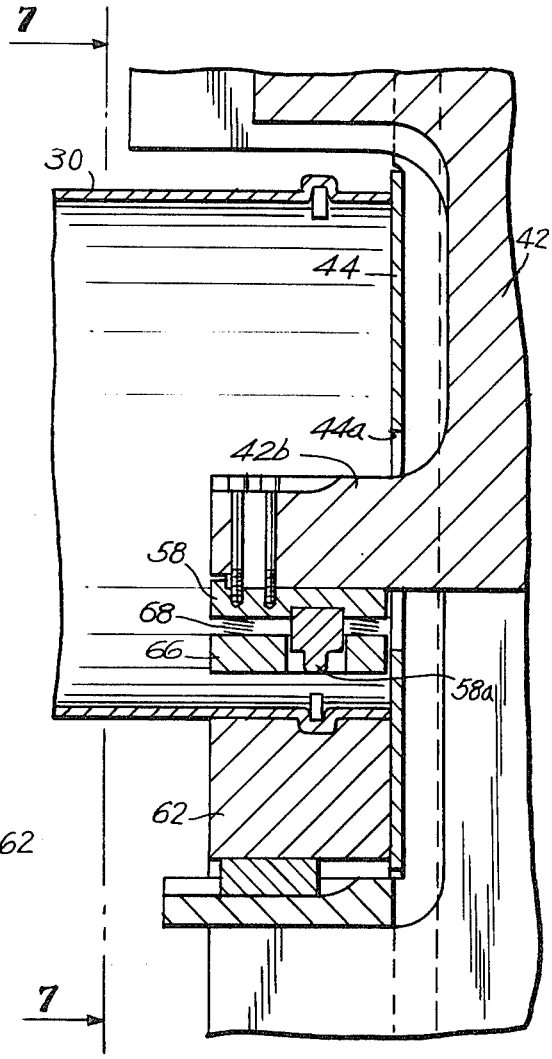
FIG. 8 is a vertical section taken on the line 8—8 of FIG. 7.
Figure 9:
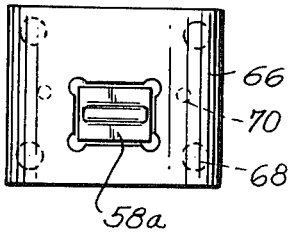
FIG. 9 is an underside plan view of the male punch assembly and combined clamping member- stripper head of FIGS. 7 and 8.

As is illustrated in FIGS. 7 through 9, the male punch assembly 58 can be provided with a clamping member 66 which is movable relatively to the male punch assembly 58, and which is biased to an extended position by springs 68. The extended position of the clamping member 66 is limited by post bolts 70 having heads which abut the punch assembly 58 and having posts which are slideably received within bores in the male punch assembly 58, the end of the posts being threaded into threaded bores in the clamping member 66.

In operation the clamping member 66 serves two purposes, the first being, on advance of the male punch assembly 58 to engage the inner periphery of the pipe 30 and clamp it firmly against the inner periphery of the female die member 62. This clamping force resists axial creep or deformation by the pulling of material from the free edge of the pipe and results in an improved appearance of the pipe end and an enhanced dimensional form of the arcuate projections 30*a*. Secondly, the clamping member 66 by virtue of the bias imposed thereon by the springs 68 acts in the function of a stripper mechanism as the male punch 58*a* is retracted, thus ensuring that the pipe be left in seated engagement with the female die member 62 so avoiding any lifting action of the pipe caused by jamming between the punch 58*a* and the arcuate projections 30*a*.

Conveniently, both the female die members 62 and the male punch assembly 58 are detachably attached to their respective supporting members by bolts, thus permitting ready removal of both of the assemblies for exchange with another pair of assemblies of different radius for use with a pipe of a corresponding diameter different to the one shown in the drawings.

Figure 10:
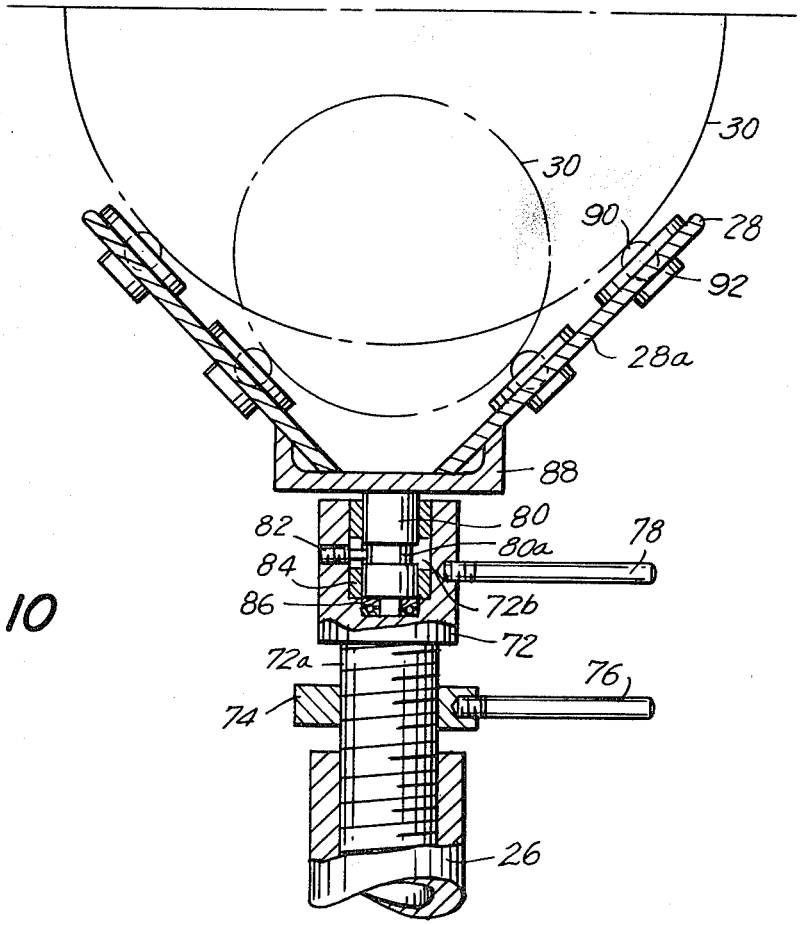
FIG. 10 is a fragmentary cross-section elevation of the pipe support member of the apparatus.

Referring now to FIG. 10, there is more clearly illustrated to the manner in which the pipe support member 28 is constructed and supported by the vertical post 26. The post 26 is tubular in form and internally threaded. The lower end of member 72 is male threaded at 72*a*, and is received within post 26, and allows for axial vertical adjustment via a plurality of pins 78, only one of which is shown. Such pins are secured to member 72. On member 72 exists a cylindrical nut 74. A plurality of pins 76, only one is shown, are attached to the cylindrical nut 74 to allow for rotation of the cylindrical nut 74 relative to the threaded portion 72*a* of member 72. The cylindrical nut 74 acts as a jam nut to secure post 72 relative to post 26 after a vertical position has been established.

Received within a bore 72*b* in the upper end of the cylindrical member 72 is a rotatable shaft 80, the rotatable shaft being secured against removal from the bore by a threaded pin 82 having an end which is received within a groove 80*a* in the rotatable shaft 80. Cylindrical oil retaining anti-friction bearings 84 are located within the bore 72*b* and rotatably support the shaft 80, and, a thrust bearing 86 is positioned in the bottom of the bore and provides the required support for the shaft 80 and the structures supported by the shaft.

As is more clearly illustrated in FIG. 10, the pipe support member 28 is supported by the shaft 80 by means of a U-shaped yoke 88 which is welded or otherwise secured to the upper end of the shaft 80. The arms of the yoke extend upwardly, and, are welded or otherwise secured to a right-angled channel member 28*a* whose arms are arranged at an angle of 45° to the horizontal. Carried by both arms of the channel member 28*a* are balls 90 received within anti-friction housings 92, the anti-friction housing being rigidly attached to the respective arms of the channel member 28*a* with the balls contained therein freely rotatable universally in any direction. The balls 90 provide for both rotation of the pipe about its axis, and, movement of the pipe longitudinally of its axis with equal facility. By providing plural sets of balls and anti-friction housings, the pipe support member 28 is adapted to receive and support pipes of widely varying outside diameters, as is indicated by the chain-dotted lines in FIG. 10.

In addition to providing for rotary and axial movement of the supported pipes, the pipe support member 28 also provides for swinging of the pipe into and out of the forming head 22, thus greatly facilitating the handling of the pipe. Additionally, by virtue of the adjustable supporting posts, the pipe support member can be raised or lowered as necessary in order to bring a horizontal tangent at the bottom end of the pipe into coplanar relationship with a horizontal tangent at the bottom of the female die, thus ensuring that the longitudinal axis of the pipe, without regard to its diameter, is brought into position in which it is perpendicular to the face of the abutment plate 44. In this way, inaccuracies in the positioning of the formed arcuate radial projections 30*a* relative to the end face of the pipe are minimized to the greatest possible extent, or, are eliminated in their entirety.

Turning now to FIGS. 11 through 14, which illustrate a gauge 94 which has particular utility in the performance of the method of the present application, the gauge illustrated is formed from a flexible flat strip of metal or other suitable material having upturned ends 94*a*. In use, the gauge 94 is wrapped around a pipe of appropriate external diameter, and, the flanges 94*a* thereof are brought into parallel relationship with each other with the flanges 94*a* positioned on opposite ends of the weld seam 30*b* of the pipe, assuming, of course, that the pipe is a welded pipe.

The gauge may either be hand held, or, any convenient means may be used for holding the gauge in position during the marking of the pipe end to provide indications of the location of a plurality of forming zones equally spaced about the external circumference of the pipe. The respective locations are determined by notches 94*b* formed in one longitudinal edge of the gauge, the respective notches including a scribing or marking edge which extends transversely of the gauge, and which thus extends axially of the pipe when the gauge is applied to the pipe end. Having correctly located the gauge close to the pipe end, a scribe or marker is then used to mark on the exterior periphery of the pipe the location of the respective forming zones, as determined by the transversely extending edges of the notches 94*b*.

The marking of the pipe for the forming zones to be spaced on opposite sides of the weld seam 30*b* ensures that the weld seam shall not accidently be positioned within a forming zone, but instead shall be positioned between an adjacent pair of forming zones. It is here commented that the ductility of the metal forming the pipe varies at the weld seam, and, that any attempt to form the pipe with a radially extending arcuate projection which extended through the weld seam could result in fracturing of the weld seam or perforation thereof by cracking or partial splitting of the weld seam, conditions which must be avoided in that the arcuate projections are positioned beyond the ends of the sealing gasket. The positioning of the zones circumferentially of drawn pipe is, of course, immaterial in that there is no weld seam to be contended with.

Having ensured that the end of the pipe is sufficiently square for the intended end purpose, and having marked the positions of the respective forming zones, the pipe is then placed on the pipe support member 28, this operation being facilitated in that the pipe support member 28 can be swung in a horizontal plane, thus eliminating the necessity of initially placing the pipe in the required position relative to the forming head 22.

Having placed the pipe in the pipe support member, the pipe and the pipe support member 28 can then be rotated until the end of the pipe is in alignment with the opening in the female die.

By then axially sliding the pipe on the pipe support member 28, the end of the pipe to be formed can be brought into abutment with either the female die 62 or the abutment plate 44. It can then be determined whether the pipe support member 28 and thus the supported pipe must be raised or lowered in order that the lower outside edge of the pipe is coincidental with the tangent through the bottom of the radial opening in the die. The adjustment of the vertical position of the pipe support member 28 is effected by applying rotational force to the pins 78, which in turn causes rotation of member 72, the threads 72*a* in co-operation with the internal threads of post 26 cause the pipe support arrangement 28 to be raised or lowered depending upon the direction of rotation and the direction of the screwed thread. The arrangement is secured in a given position against further rotation by rotating the nut 74 via the pins 76 until it abuts the top of the post 26. The pipe, so supported, can now be rotated without further affecting the height of its longitudinal axis.

Having accurately positioned the location of the longitudinal axis of the tube in a vertical plane, the pipe is then slid into the female die member 62 and into face contact with the abutment plate 44, assuming of course, that it was not initially in engagement with the abutment plate 44. At this point, the longitudinal axis of the pipe will be parallel to the bed of the machine and thence at 90° to the abutment plate 44.

The pipe is then rotated about its longitudinal axis to bring any one of the previously applied marks on its periphery thereof into registration with an alignment mark or index mark on the forming head 22. Having done this, the punch assembly 58 is then moved downwardly, thus moving the punch 58*a* and the clamping member 66 into engagement with the inner surface of the pipe wall. The pipe is thus clamped in position, and, the formation of a radially extending arcuate projection 30*a* proceeds by the displacement of the metal beneath the punch 58*a* into the grooved forming channel 62*b* of the female die member 62.

Upon retraction of the male punch assembly 58, the clamping member 66 acts to strip the pipe from the punch 58*a*, and, hold the pipe in seated engagement with the female die member 62 until such time as the post bolts 70 abut on the punch assembly 58 and prevent further downward movement of the clamping member 66. At this point, the clamping member 66 moves upwardly and out of engagement with the pipe.

The pipe is then rotated about its longitudinal axis to bring the next marking on the circumference of the pipe into alignment with the alignment mark on the forming head 22, during which time the formed projection 30*a* rides within the groove or channel 62*b*, this having the additional advantage of preventing unintentional movement of the pipe relative to the female die member 62 and ensuring that subsequent arcuate projections lie in the same plane perpendicular to the pipe longitudinal axis. The male punch member is then again operated to form the next radially extending arcuate projection 30*a*, and, this sequence is repeated until all of the arcuate projections 30*a* are formed.

As will be appreciated, the method of the present application provides that neither the index mark on the forming head 22 or marking for the zone on the pipe to be formed needs to be positioned within the actual zone of formation, at which point it would be extremely difficult to observe. Instead, the index on the forming head 22 is located in a position in which it is readily viewable by a workman and generally without regard to which side of the apparatus is employed as the work station by the workman.

Various modifications may be made in the specific structure of the apparatus without departing from the scope of the invention as defined by the appended claims. For example, in substitution for the hydraulic piston and cylinder arrangement 48, any other convenient source of pressing force could be employed, including mechanical and electromechanical devices, such as a manual source comprised by a cam follower carried by the carriage 42 and which cooperates with a rotary cam carried by the platform 52, the cam having associated therewith a lever which is manually operable by the workman to rotate the cam. Alternatively, the rotary cam could be one which is driven through an appropriate gear reduction chain from an electric or other motor.

With respect to the vertical lift mechanism for the pipe support member 28, clearly, other structures such as cam-operated lifts or hydraulically operated lifts could be employed where convenient, the major requirements in the apparatus being that the pipe 30 shall be positionable with its longitudinal axis truly perpendicular to the face of the abutment plate 44 and correctly positioned in height relative to the female die member 62, and, that the male punch assembly 58 move in a plane which is truly parallel to the plane of the abutment plate 44 and perpendicular to the longitudinal axis of the pipe.

What is claimed is:

1. Apparatus including an axially straight bed frame, a pipe support member selectively positionable longitudinally of said bed frame, members for locking said pipe support member in a selected position longitudinally of said bed frame, and a forming head rigidly attached to said bed frame at one end thereof, the forming head including a stop member for engagement by and the accurate axial positioning of a pipe end, a main frame supported on said bed frame and having a female die member fixedly supported thereon in predetermined position with said female die member spaced from said stop member and intermediate said stop member and said pipe support member, a male punch member movably supported on said mainframe for movement towards and away from said female die member, said female die member and said male punch member extending arcuately and in axial alignment with each other in a plane transverse to said bed frame, and a source of motive power mounted on said mainframe and connected to move said male punch member between a retracted position spaced from said female die member and an advanced position in operative cooperation with said female die member and for supplying pressing force to said male punch member.

2. The apparatus according to claim 1, in which said pipe support member includes a vertical post carried by said guide members, means for adjusting the height of said post, and, a pipe support carried by said post and supported by said post for pivoting movement in a horizontal plane.

3. Apparatus according to claim 2, in which said pipe support is of V-shaped transverse cross-section, each internal side face of said pipe support having universally pivoted members associated therewith facilitating rotational and axial movement of a pipe supported thereby.

4. The apparatus according to claim 1, in which said female die member includes an arcuate surface for the support of a pipe end, and an arcuate die groove which is open at its ends to permit the escape of a formed arcuate projection upon rotation of said pipe end about the longitudinal axis thereof.

5. The apparatus of claim 1, in which said male punch member is supported for movement between said retracted and advanced positions by guides positioned at that side of said stop member which is remote from said female die member, said male punch member extending from said guide members into vertically spaced alignment with said female die member for it to be positioned internally of the end of a pipe.

6. The apparatus of claim 5, in which said male punch member includes a retractable clamping shoe carried by said male punch member and which is resiliently biased towards said female die member, said retractable clamping shoe being dually operative to clamp a pipe end in intimate contact with said female die member upon advance of said male punch member and to strip said pipe from said male punch member upon retraction of said male punch member.

7. The apparatus of claim 1, in which said source of motive power is a fluid operated piston and cylinder, having a mechanical spring means for return movement of said piston.

* * * * *